US005440642A

United States Patent [19]

Denenberg et al.

[11] Patent Number: 5,440,642

[45] Date of Patent: Aug. 8, 1995

[54] ANALOG NOISE CANCELLATION SYSTEM USING DIGITAL OPTIMIZING OF VARIABLE PARAMETERS

[76] Inventors: Jeffrey N. Denenberg, 345 Putting Green Rd., Trumbull, Conn. 06611; Randy V. Sabett, 8908 Liberty Rd., Randallstown, Md. 21133

[21] Appl. No.: 123,928

[22] Filed: Sep. 20, 1993

[51] Int. Cl.[6] ..... H04R 25/00

[52] U.S. Cl. ..... 381/71; 381/94

[58] Field of Search ..... 381/71, 94; 415/119; 267/136

[56] References Cited

U.S. PATENT DOCUMENTS

| | | | |
|---|---|---|---|
| 4,837,832 | 6/1989 | Fanshel | 381/71 |
| 5,105,377 | 4/1992 | Ziegler . | |
| 5,140,640 | 8/1992 | Groupe et al. | 381/71 |
| 5,146,505 | 9/1992 | Pfaff et al. | 381/71 |
| 5,216,721 | 6/1993 | Melton | 381/71 |
| 5,259,033 | 11/1993 | Goodings et al. | 381/71 |
| 5,321,759 | 6/1994 | Yuan | 381/71 |
| 5,325,437 | 6/1994 | Doi et al. | 381/71 |

*Primary Examiner*—Stephen Brinich
*Attorney, Agent, or Firm*—James W. Hiney

[57] ABSTRACT

A digitally controlled analog cancellation system containing an analog noise cancellation circuit with a residual microphone (39) with a digital virtual earth controller (40) for optimizing variable parameters employed in the analog cancellation circuit.

9 Claims, 5 Drawing Sheets

ANALOG NOISE CANCELLATION SYSTEM USING DIGITAL OPTIMIZING OF VARIABLE PARAMETERS

This invention relates to the use of a digital signal processor (DSP), or other microprocessor to control various adjustable parameters in an analog active cancellation system. The adjustment of these parameters at calibration time of the system permits the parameters of the analog cancellation system to be matched to the characteristics of the other components used in the system. This adjustment would be necessary when the cancellation electronics are packaged separately from the rest of the cancellation system (e.g. the speakers, microphones, and external gain devices).

The example application, (used for illustrative purposes only), is a headset for emergency vehicles. However, this invention relates to any system that would use a digital means to control and adjust the system parameters of an analog cancellation system. In this particular example, the digital system consists of an active noise cancellation controller implementing the "Digital Virtual Earth" algorithm as described in U.S. Pat. No. 5,105,377 and incorporated by reference herein. Alternatively, the digital system consists of a general purpose microprocessor and associated input/output circuitry. The analog cancellation electronics consist of a "Noise-Buster" circuit as described in a co-filed U.S. application on Sep. 20, 1993, incorporated by reference herein.

Setting of the parameters of the analog cancellation system could be accomplished manually in the factory by trained technical personnel using sophisticated instrumentation, but would not be possible for an average user. Further, preset factory values would preclude the separate packaging of the electronics and the rest of the system.

Accordingly, it is an object of this invention to provide a system employing a digital microprocessor to control the parameters of an analog cancellation system in an automated fashion, thus providing superior results over systems with non-adjustable parameters. It is a further object of this invention to improve system flexibility by allowing the cancellation electronics to be packaged separately from the rest of the cancellation system. These and other objects will become apparent when reference is made to the accompanying drawings in which FIG. 1 is a block diagram of a digitally controlled analog filter building block.

Digitally controlled analog filter building block

Figure 1:
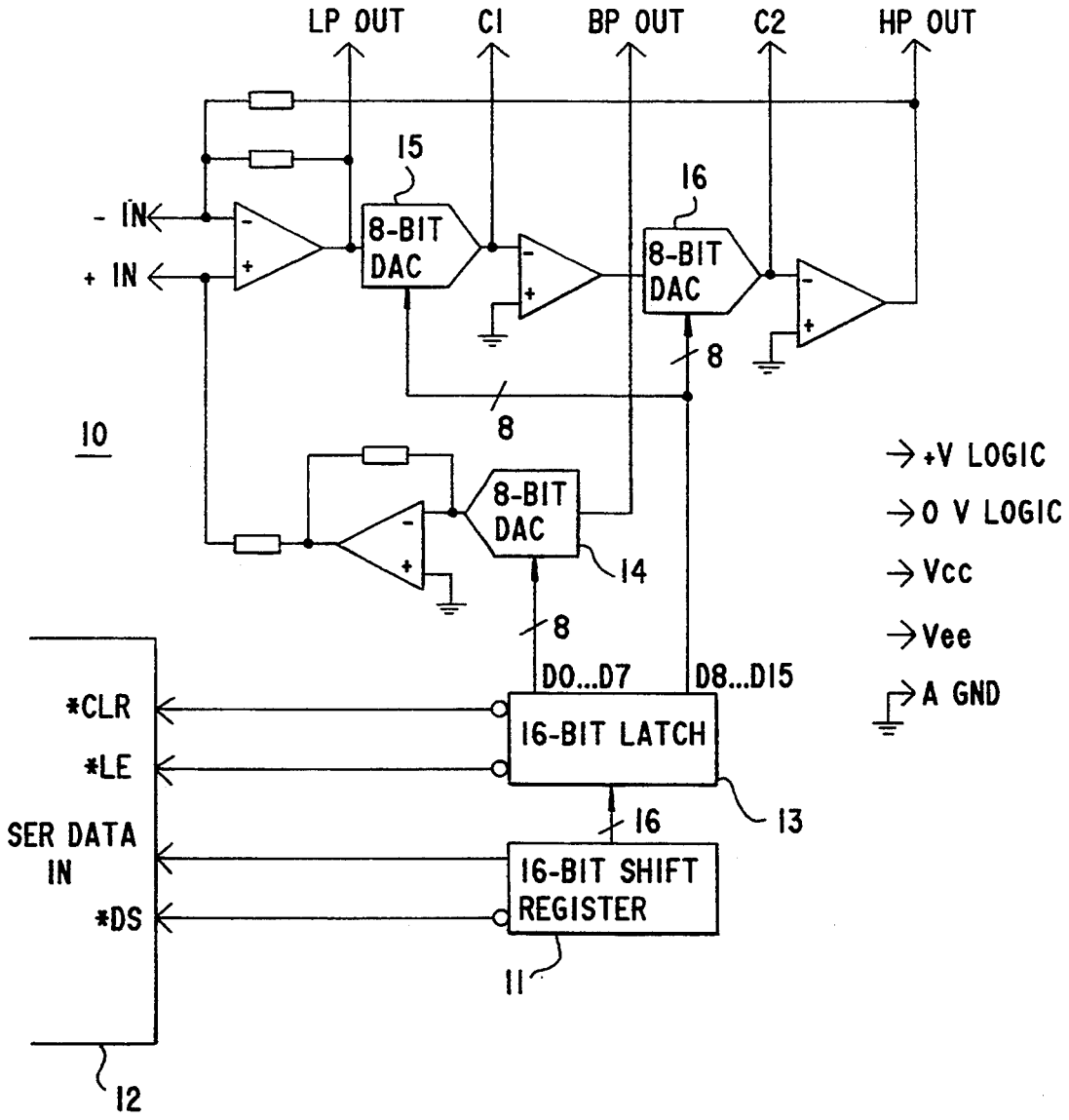

One aspect of the present invention will be described with reference to the accompanying FIG. 1. The basic building block of the present invention, a digitally controlled analog filter building block 10, is shown consisting of a 16-bit shift register 11 connected to the serial port of the microprocessor 12 in the digital system, the output of which gets stored in a 16-bit latch 1:3. The lower (least significant) bits of this latch are used to set the resistance value of the low pass portion of the filter. This value varies as the digital value sent to the 8-bit C/A 14 is varied. Similarly, the upper (most significant) bits of this latch are used to set the resistance value of the bandpass and highpass portion of the filter. These resistance values vary as the values sent to D/A 15 and D/A 16 vary.

Digitally controlled analog filter

Figure 2:
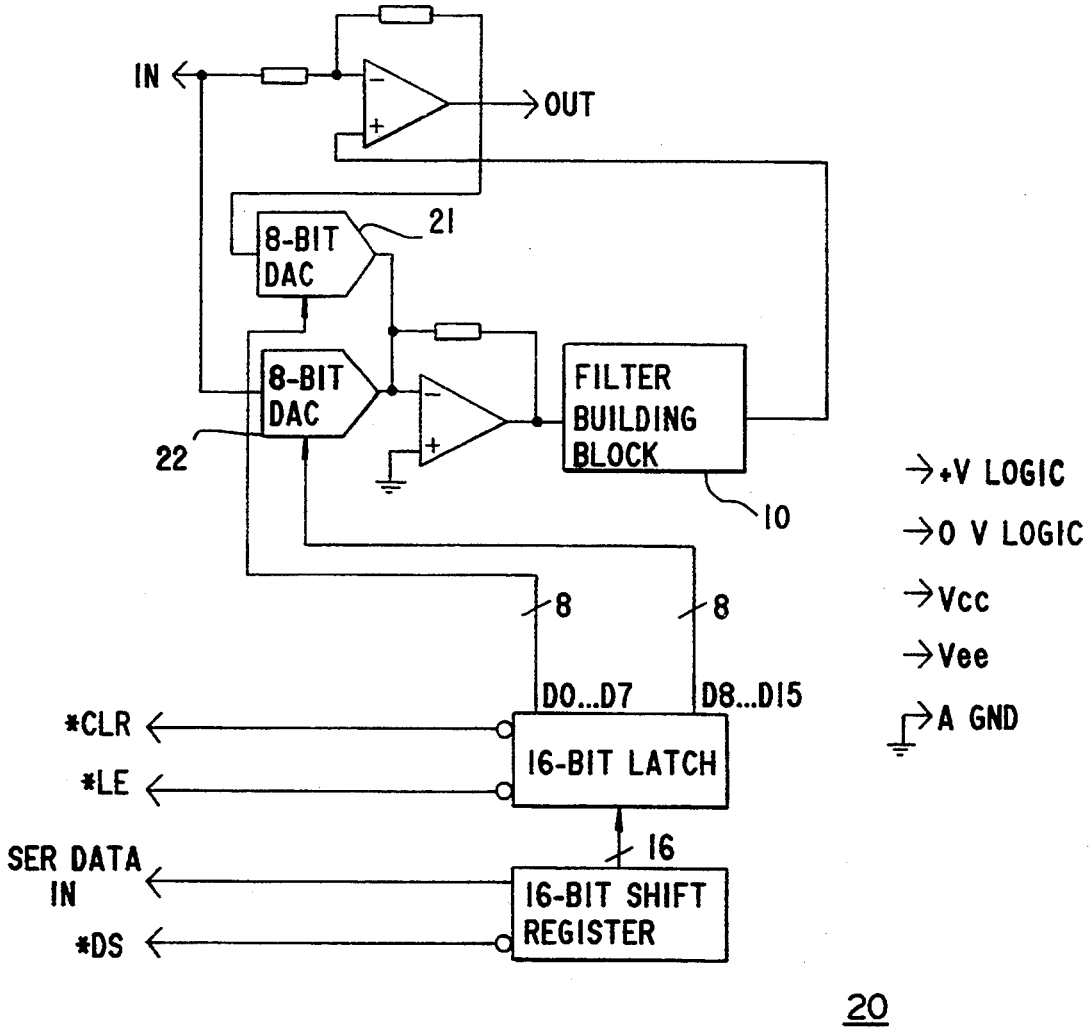
FIG. 2 is a block diagram of a digitally controlled analog filter.

A further aspect of the present invention will be described with reference to the accompanying FIG. 2. A complete analog filter is shown utilizing the building block described above (and shown in FIG. 1). The complete filter 20 consists of the digitally controlled analog filter building block 10, with the gain of the system being adjusted by the two 8-bit D/A's 21 and 22.

Parameters to be adjusted

The example system described contains two different mechanisms which require parametric adjustment to ensure system stability. First, adjustment of the loop gain determines the amount of cancellation achievable by the headset. If the gain setting is too low, there will be too little cancellation. If too high, the system could become unstable resulting in unpleasant or even damaging loud noise at the ear.

Second, adjustable equalization of the system permits the transfer function to be "flattened" resulting in maximized stable cancellation. This optimization compensates for variations from unit to unit due to differences in microphones, speakers, and other electronic components. Additionally, variations resulting from components changing with age can be taken into account.

Automatic loop gain

Since the loop gain determines the overall cancellation effectiveness of the system, it is the primary parameter of interest. In the example system, the gain of the speaker can vary by as much as 2 dB between units, and the gain of the microphone up to 5 dB between units. The adjustment must therefore have a 10 dB range. If the desired cancellation effectiveness is 12 dB, a variation of 1 dB (20%) in the adjusted loop gain yields a variation of 3 dB in the cancellation effectiveness.

Figure 3:
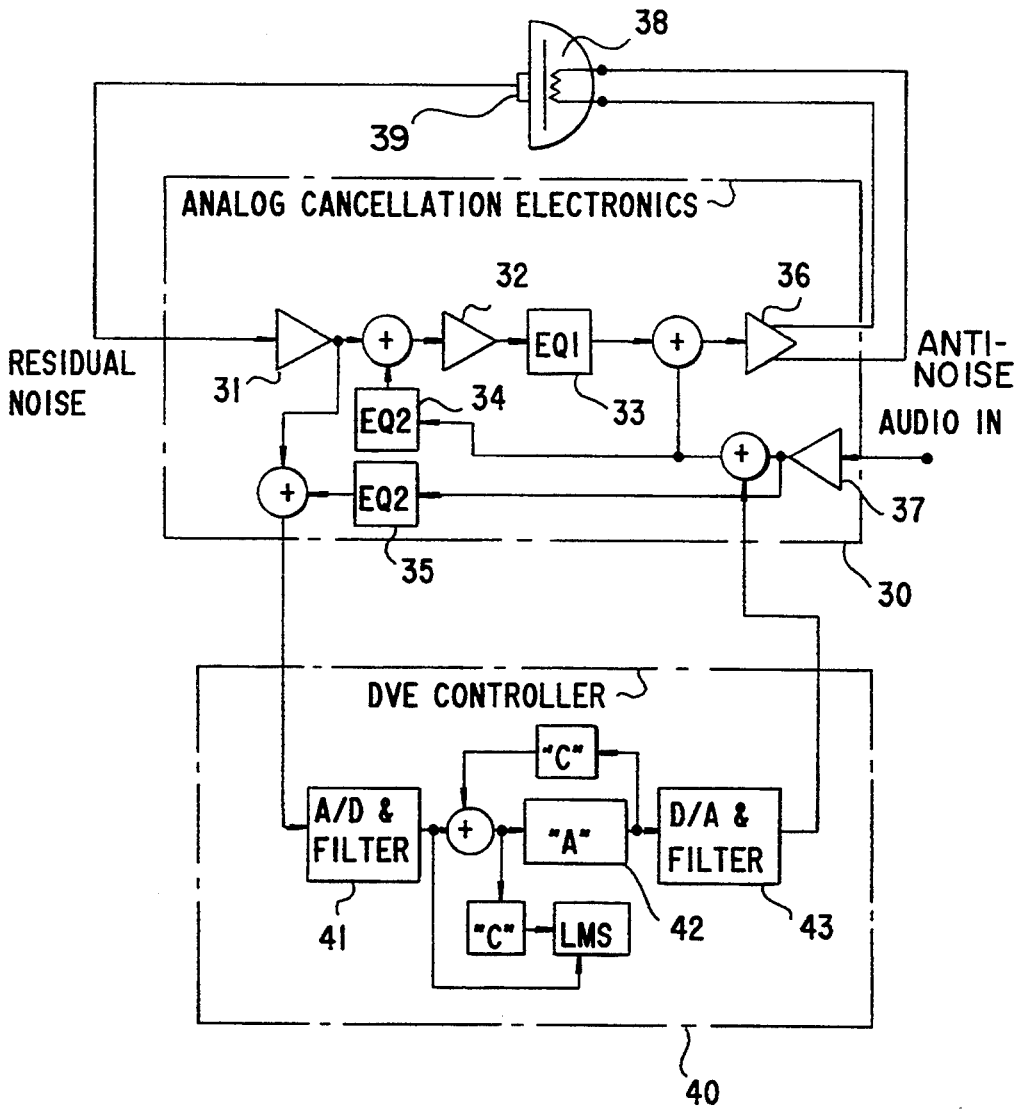
FIG. 3 is a block diagram of a hybrid noise canceling system.
Figure 4:
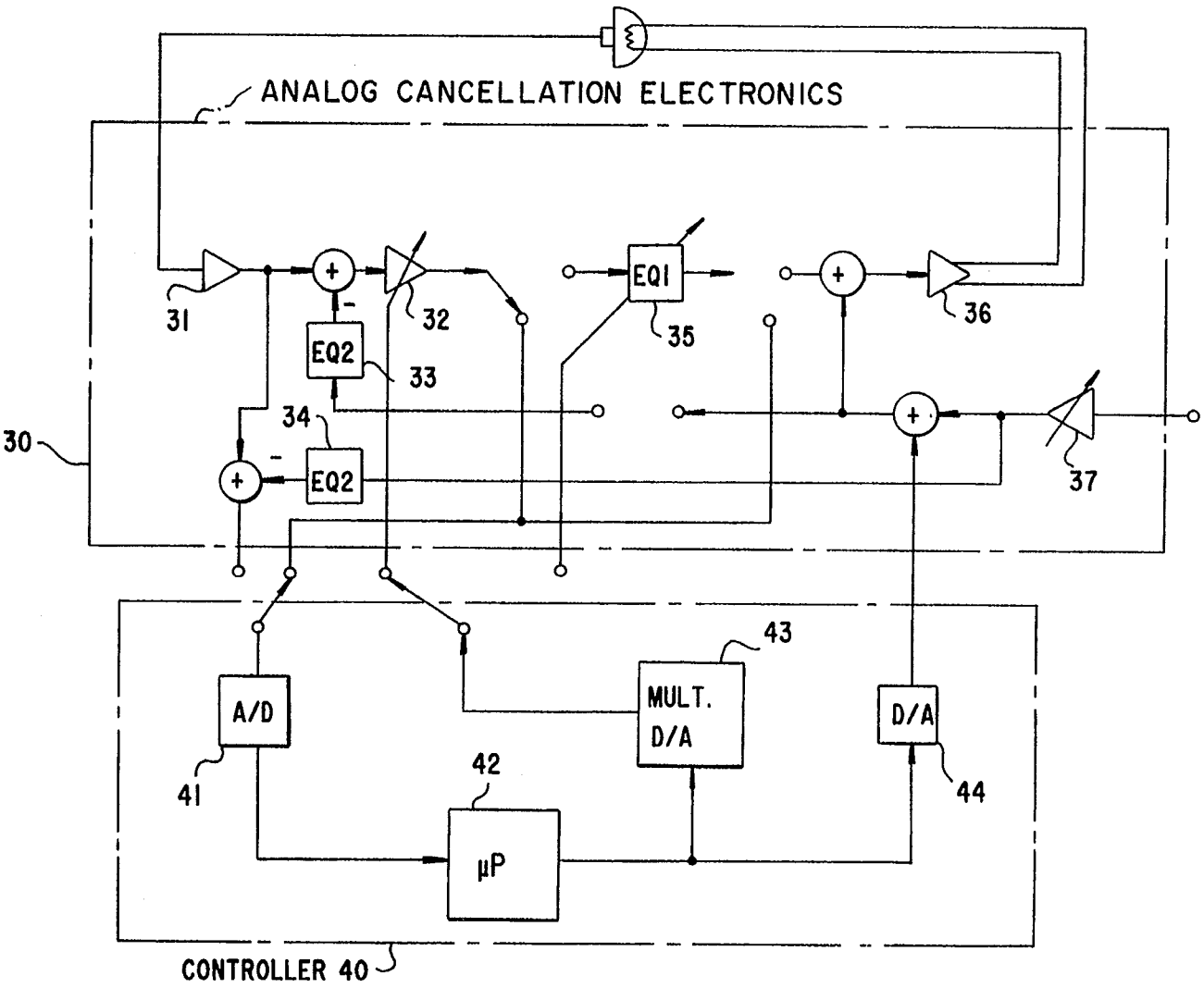
FIG. 4 is a block diagram of a hybrid noise cancellation system showing the automatic gain setting.
Figure 5:
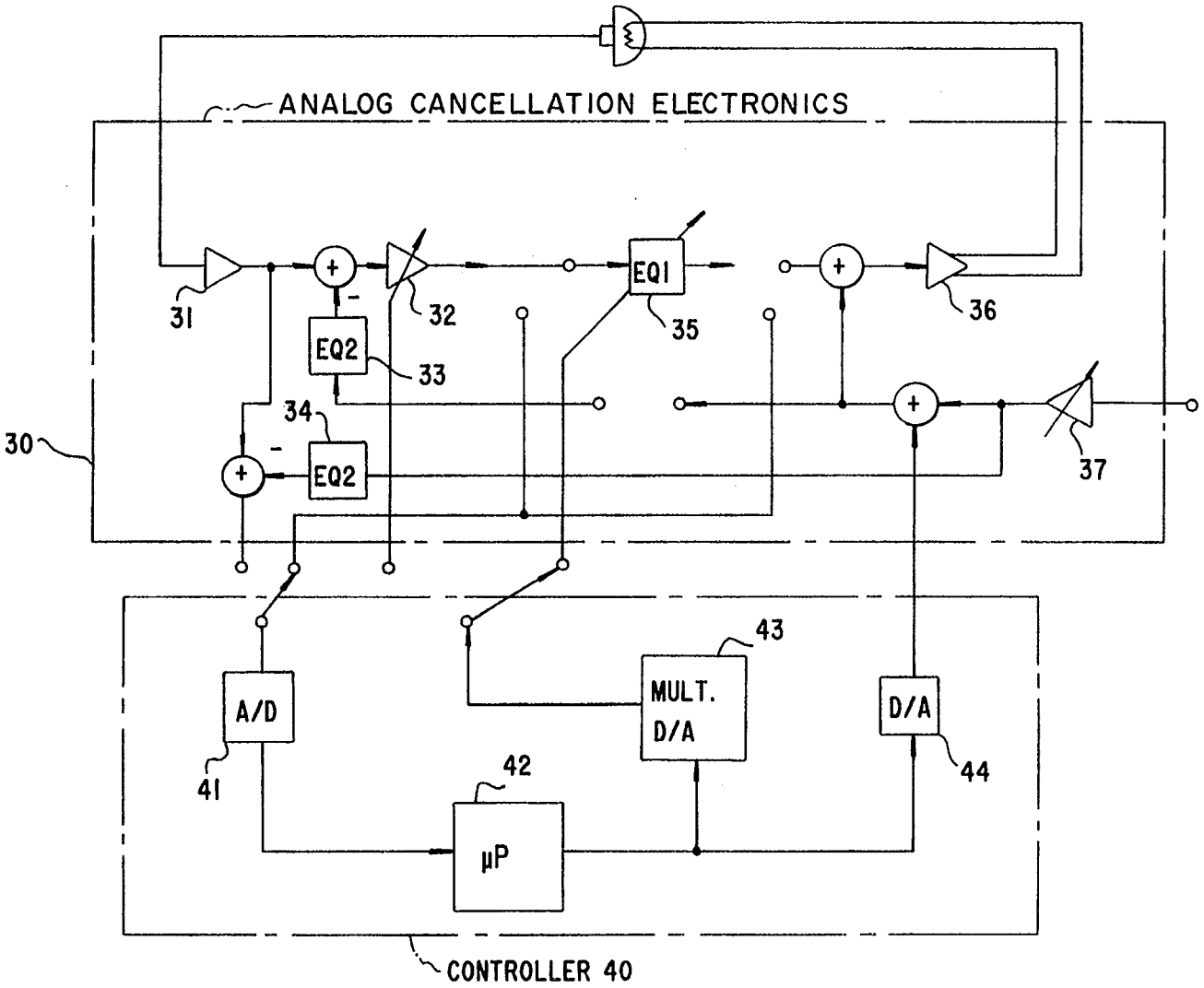
FIG. 5 is a block diagram of a hybrid noise cancellation system showing the automatic equalization setting.

By way of example this aspect of the present invention will be described with reference to the accompanying drawings. In FIG. 3, the combination of the digital system is shown combined with the analog cancellation electronics. The system uses an analog cancellation system 30 with microphone preamplifier 31, cancellation gain 32, equalizers 33, 34, and 35, output amplifier 36, and audio gain 37. System 30 is connected to controller 40 having analog to digital converter (A/D) and filter 41, microprocessor 42, parameter setting digital to analog converter (D/A) 43, and output D/A and filter 44. During calibration of the system, predetermined output would be generated by the controller 40 and output through the D/A and filter 43 to the output amplifier 36 resulting in a calibration tone at the headset speaker 38. The resulting output of the residual microphone 39 due to the calibration signal would then be amplified by the microphone preamplifier 31, and the amplified signal would be used by the DVE controller to correctly adjust the cancellation gain 32. This cancellation gain 32 would be adjusted by the controller via the parameter setting D/A 43.

In the more specific case, this invention could be implemented with the analog cancellation electronics controlled by a DVE controller consisting of a DVE cancellation engine, an A/D to acquire the input samples, and a D/A to generate the output samples. With this specific configuration, the necessary adjustment of the analog system parameters could easily be made, and the cancellation of the system would be improved even further.

Automatic equalizer setting

In an analog filter, the locations of the poles and zeroes are determined by the values of the resistors, capacitors, and inductors in the circuit. Since the maximum stable cancellation at any particular loop gain is determined by the flatness and delay in the equalized loop, the ability to vary the frequency and damping of poles and zeroes in the filters of the equalizer greatly increases the effectiveness of the active noise cancellation system.

Again, by way of example this aspect of the present invention will be described with reference to the accompanying drawings. As described previously, and with reference to FIG. 3, the digital system would produce a calibration signal to be used to adjust the system parameters of the analog cancellation system. During calibration of the system, predetermined output would be generated by the DVE controller 40 and output through the D/A and filter 44 to the output amplifier 36 resulting in a calibration tone at the headset speaker 38. In order to set the values of the adjustable equalizer, the digital system would first set the two EQ2 equalization stages 34 and 35 for a flat response (since these two stages are strictly used to remove the effects of the analog cancellation electronics and the audio in from the feedback to the digital processor). The processor would then iteratively adjust the EQ1 equalization 33 to obtain the desired level of attenuation in the active band. At the same time, it would avoid a setting which would cause instability. This dynamic adjustment of the analog electronics ensures that the cancellation provided by that subsystem is optimized without the need for manual adjustment, and without the need for servicing.

We claim:

1. A hybrid noise cancellation system for canceling unwanted noise, said system comprising a first noise canceling electronic means for canceling low frequency noise, and a second noise canceling electronic means for canceling periodic noise, said first and second noise canceling means being connected and implemented in such a way that the second noise canceling means optimizes variable parameters employed in the first noise canceling means.

2. A system as in claim 1 wherein the first noise canceling means is an analog system means.

3. A system as in claim 2 wherein the analog system means contains a digitally controlled analog filter building block comprising a means to acquire a digital input value, a means to latch such acquired digital input value, and a means to adjust the parameters of said analog filter building block.

4. A system as in claim 3 wherein said analog system means is a feedback control system.

5. A system as in claim 3 wherein said analog system means is a feed-forward system.

6. A system as in claim 2 wherein said second noise canceling electronic means comprises a digital virtual earth system.

7. A system as in claim 3 wherein said second noise canceling electronic means comprises a digital virtual earth system.

8. A system as in claim 4 wherein said second noise canceling electronic means comprises a digital virtual earth system.

9. A system as in claim 5 wherein said second noise canceling electronic means comprises a digital virtual earth system.

* * * * *